US010782630B2

(12) United States Patent
Sato et al.

(10) Patent No.: US 10,782,630 B2
(45) Date of Patent: Sep. 22, 2020

(54) IMAGE FORMING APPARATUS WITH MOVABLE SUPPORT MEMBER

(71) Applicant: BROTHER KOGYO KABUSHIKI KAISHA, Nagoya-shi, Aichi-ken (JP)

(72) Inventors: Shougo Sato, Seto (JP); Yasutada Kato, Nagoya (JP); Yasuo Fukamachi, Nagoya (JP); Kazuna Taguchi, Nagoya (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 16/598,677

(22) Filed: Oct. 10, 2019

(65) Prior Publication Data

US 2020/0133159 A1 Apr. 30, 2020

(30) Foreign Application Priority Data

Oct. 26, 2018 (JP) ..... 2018-202110

(51) Int. Cl.
*G03G 21/16* (2006.01)
*G03G 21/18* (2006.01)
(Continued)

(52) U.S. Cl.
CPC ..... *G03G 15/0808* (2013.01); *B65H 5/06* (2013.01); *B65H 5/36* (2013.01); *G03G 21/1814* (2013.01);
(Continued)

(58) Field of Classification Search
CPC ..... G03G 15/0808; G03G 21/1623; G03G 21/1633; G03G 21/18; G03G 21/1814;
(Continued)

(56) References Cited

U.S. PATENT DOCUMENTS

2005/0214025 A1* 9/2005 Itabashi ..... G03G 21/1821 399/113
2010/0329734 A1* 12/2010 Hayakawa ..... G03G 15/0896 399/119
(Continued)

FOREIGN PATENT DOCUMENTS

JP 2008-105791 A 5/2008
JP 2012-168272 A 9/2012

*Primary Examiner* — Sophia S Chen
(74) *Attorney, Agent, or Firm* — Merchant & Gould P.C.

(57) ABSTRACT

An image forming apparatus employing an electrophotographic image forming method includes a casing having a front wall to which an opening is formed and a rear wall facing the front wall, a photosensitive drum located close to the front wall, a support member configured to support the photosensitive drum. The support member is slidably movable between an accommodated position a drawn position at which the photosensitive drum is drawn out of the casing through the opening. The image forming apparatus further includes a sheet tray, a feeding roller configured to feed the plurality of sheets supported by the sheet tray, a first conveying guide arranged between the support member and the sheet tray to face the support member, and a second conveying guide formed to the support member at a position facing the first conveying guide to guide the sheet inserted through the opening.

11 Claims, 15 Drawing Sheets

(51) Int. Cl.
*G03G 15/08* (2006.01)
*B65H 5/06* (2006.01)
*B65H 5/36* (2006.01)

(52) U.S. Cl.
CPC ... *B65H 2402/441* (2013.01); *G03G 21/1633* (2013.01); *G03G 2221/1869* (2013.01)

(58) Field of Classification Search
CPC ..... G03G 21/1842; G03G 21/1846; G03G 21/1853; G03G 2221/1678; G03G 2221/1846; G03G 2221/1869
See application file for complete search history.

(56) References Cited

U.S. PATENT DOCUMENTS

| | | | | |
|---|---|---|---|---|
| 2012/0207510 | A1 | 8/2012 | Sato | |
| 2015/0185687 | A1* | 7/2015 | Mikuni ..... | G03G 21/1661 399/90 |
| 2017/0219995 | A1* | 8/2017 | Sato ..... | G03G 21/1853 |
| 2017/0285567 | A1* | 10/2017 | Fukaya ..... | G03G 21/1814 |
| 2018/0284649 | A1* | 10/2018 | Minoshima ..... | G03G 21/1814 |

* cited by examiner

IMAGE FORMING APPARATUS WITH MOVABLE SUPPORT MEMBER

CROSS-REFERENCE TO RELATED APPLICATIONS

This application claims priority under 35 U.S.C. § 119 from Japanese Patent Application No. 2018-202110 filed on Oct. 26, 2018. The entire subject matter of the application is incorporated herein by reference.

BACKGROUND

Technical Fields

The present disclosures relate to an image forming apparatus employing an electrophotographic imaging method.

Related Art

There has been known an image forming apparatus having a sheet conveying passage extending from a sheet tray to a discharge tray, a part of the sheet conveying passage being curved to be C-shaped (hereinafter, such a C-shaped conveying passage will be simply referred to as a "C-shaped passage"). Among such image forming apparatuses, there are ones in which the C-shaped passage is arranged on a rear wall side of the image forming apparatus. For example, there is known an image forming apparatus, in which a manual insertion tray is provided on a front wall side of a casing of the image forming apparatus. There is also provided a conveyance guide, which is arranged above the sheet tray and is configured to guide the sheet placed on the manual insertion tray to be conveyed from the front wall side to the rear wall side, defining a manual insertion sheet conveying passage. Typically, in such an apparatus, in order to enable jam processing which is processing of dealing with a sheet jam condition, after the sheet tray is removed from the image forming apparatus, the conveyance guide is moved downward into a space which was occupied by the sheet tray before removed, thereby the manual insertion conveying passage being opened.

SUMMARY

When image forming apparatus is configured such that the sheet tray is arranged at a bottom part of the image forming apparatus, it is necessary that the sheet tray is removed from the image forming apparatus and a user looks into the manual insertion conveying passage through the space located at the bottom part of the image forming apparatus when, for example, the jam processing (e.g., a process of removing a jammed sheet from the passage) is performed. That is, in a conventional image forming apparatus configured as above, it is relatively difficult for the user to visually recognize a portion subject to the jam processing.

According to aspects of the present disclosures, there is provided an image forming apparatus configured to form an image in accordance with an electrophotographic image forming method. The image forming apparatus is provided with a casing which has a front wall having an opening, a rear wall and a first conveying guide configured to guide a sheet inserted through the opening in a direction from the front wall toward the rear wall. The image forming apparatus is further provided with a process cartridge having a photosensitive drum, a support member having a second conveying guide configured to guide sheet inserted through the opening, the support member being configured to support the process cartridge, and the support member being slidably movable between an accommodated position at which the process cartridge supported on the supporting member is located inside the casing and a drawn position at which at least a part of the process cartridge supported on the supporting member is located out of the casing through the opening on the front wall, Further, the image processing apparatus is provided with a sheet tray configured to support sheet, the sheet tray being arranged inside the casing at a lower position with respect to the support member when the support member is at the accommodated position, a pair of registration rollers arranged inside the casing at a position closer to the rear wall than the front wall, the pair of registration rollers being configured to convey a sheet. When the supporting member is at the accommodated position, the second conveying guide faces the first conveying guide.

BRIEF DESCRIPTION OF THE ACCOMPANYING DRAWINGS

DETAILED DESCRIPTION OF THE EMBODIMENTS

Figure 1:
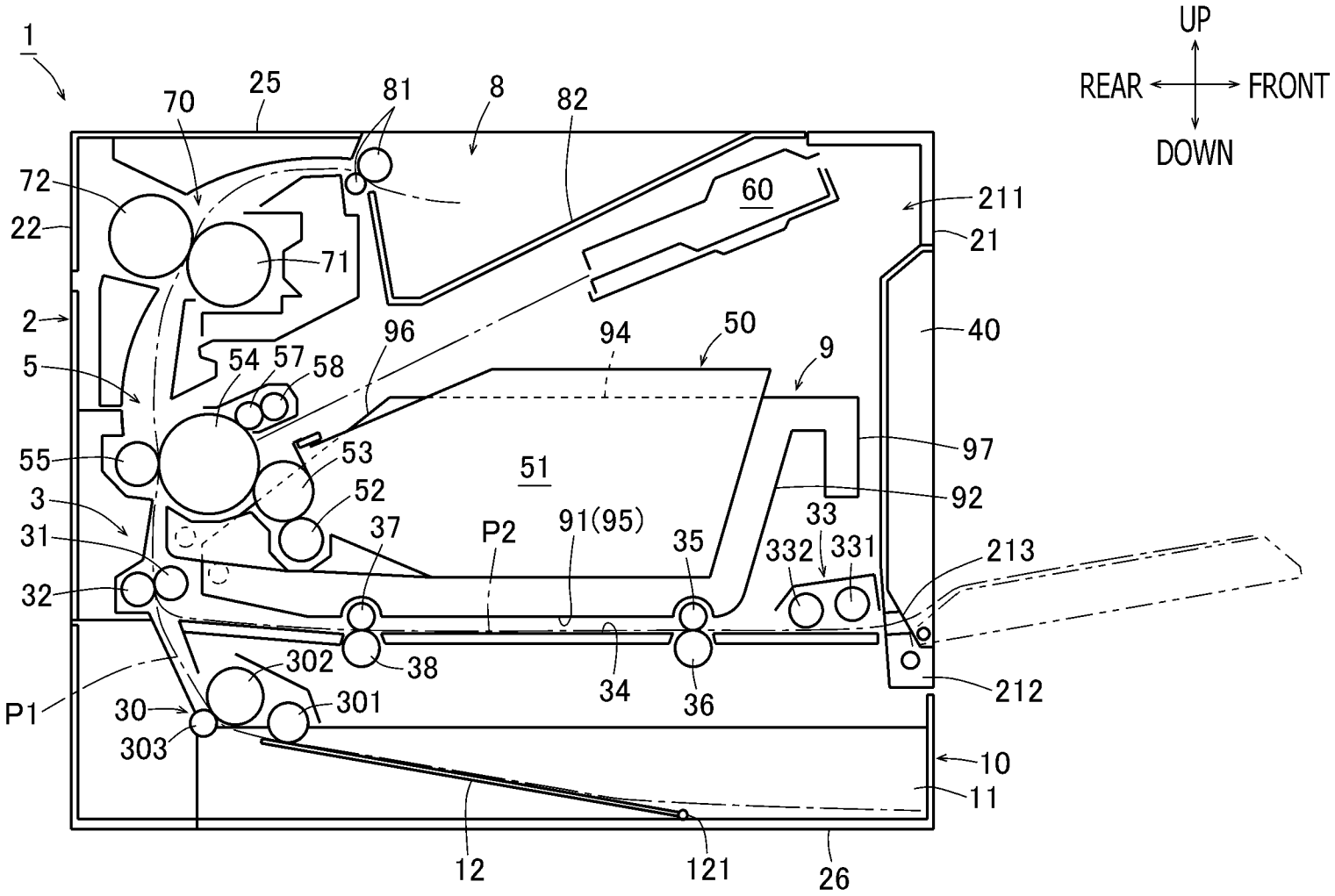
FIG. 1 is a side view schematically illustrating a configuration of an image forming apparatus according to a first embodiment of the present disclosures.

In the following description, a state in which an image forming apparatus 1 is placed as shown in FIG. 1 so as to be used will be referred to as a reference state. Further, a direction in which a sheet tray 10 is drawn (i.e., a right-hand side in FIG. 1) will be defined as a front side, while an opposite side will be referred to as a rear side. Right and left sides of the image forming apparatus 1 will be defined as directions when the image forming apparatus 1 is viewed from the front side. Furthermore, a discharge tray 82 side with respect to the image forming apparatus 1 will be referred to as an upside, while an opposite side will be referred to as a down side. An up-down direction, a right-left direction and a front-rear direction according to the above definition are indicated on each drawing.

First Embodiment

<General Configuration of Image Forming Apparatus>

FIG. 1 shows an image forming apparatus 1 according to a first embodiment of the present disclosures. The image forming apparatus 1 has a casing 2, a supplying section 3, an image forming section 5, a discharging section 8, and a support member 9 which constitutes a part the supplying section 3 and a part of the image forming section 5. The support member 9 is configured to be inserted in and drawn from the casing 2 of the image forming apparatus 1.

The casing 2 has approximately rectangular parallelepiped shape and has a front wall 21 (which is an example of a front wall), a rear wall 22 (which is an example of a rear wall), a left wall 23, a right wall 24, an upper wall 25 and a bottom wall 26. On the front wall 21 and a front portion of the upper wall 25, an opening 211 is formed. The support member 9 is inserted in or drawn from the casing 2 through the opening 211. The opening 211 is covered with an openable cover 212.

The supplying section 3 is arranged in a lower part of the image forming apparatus 1 and is configured to feed recording sheets (hereinafter, simply referred to as "sheets") held by the supplying section 3 toward the image forming section 5 one by one. The image forming section 5 is arranged on a downstream side, in the sheet conveying direction, with respect to the supplying section 3. The image forming section 5 is configured to form an image on the sheet conveyed from the supplying section 3. The discharging section 8 is arranged on a downstream side, in the conveying direction, with respect to the image forming section 5, and is configured to discharge the sheet on which an image has been formed outside the image forming apparatus 1.

The supplying section 3 has a sheet tray 10, a supplying mechanism 30, a registration roller 31, a multipurpose (MP) tray 40, an MP tray side supplying mechanism 33, a first conveying guide 34, a second conveying guide 91, a first conveying roller 35 and a second conveying roller 37.

The sheet tray 10 is detachably attached to a lower part of the casing 2. That is, the sheet tray 10 is detachable from and attachable to the lower part of the casing 2. When the sheet tray 10 is inserted in to the casing 1 rearward from the front side, the sheet tray 10 is attached to the casing 2 and is located at an attached position. When the sheet tray 10 attached to the casing 2 is drawn frontward from the casing 2, the sheet tray 10 is detached from the casing 2.

The sheet tray 10 has a main body 11 configured to support a plurality of recording sheets and a pressure plate 12 arranged in the main body 11. The plurality of recording sheets are mounted on the pressure plate 12. The pressure plate 12 is configured to be displaceable in the up-down direction with mounting the plurality of recording sheets thereon. The pressure plate 12 is rotatably supported about a fulcrum 121, and is configured to be displaced in the up-down direction by a pressure plate elevating member (not shown).

The supplying mechanism 30 is arranged on the rear wall 22 side inside the casing 2. The supplying mechanism 30 is configured to pick up the recording sheets mounted on the sheet tray 10 one by one in a separated manner and convey the same toward the registration roller 31. The supplying mechanism 30 has a pickup roller 301, a separation roller 302 and a retard roller 303. The separation roller 302 is an example of a feeding roller configured to convey the sheets supported by the sheet tray 10.

The pickup roller 301 is for picking up one of the sheets which are lifted up to a feedable position by the pressure plate 12. The pickup roller 301 is arranged above the pressure plate 12. The separation roller 302 is arranged on a downstream side, in the conveying direction, with respect to the pickup roller 301. The retard roller 303 is arranged to face the separation roller 302 and is urged toward the separation roller 302, thereby a nip being formed by the separation roller 302 and the retard roller 303.

The sheet(s) picked up by the pickup roller 301 is fed toward the separation roller 302. Then, only one sheet is separated from the other (if any) at the nip between the separation roller 302 and the retard roller 303, and conveyed through a conveying passage P1 toward the registration roller 31.

The registration roller 31 is arranged on the downstream side, in the conveying direction, with respect to the supplying mechanism 30. The registration roller 31 once regulates movement of a leading end of the sheet conveyed between the registration roller 31 and a registration driven roller 32, and thereafter, driven again to start conveying the sheet, at a particular timing, toward a transfer position.

The MP tray 40 is rotatably supported by the cover 212 so as to be rotatable between a closing position (indicated by solid lines in FIG. 1) at which the MP tray 40 covers an opening 213 formed to the cover 212 and an opening position (indicated by two-dotted lines in FIG. 1) at which the MP tray 40 uncovers the opening 213 (i.e., the opening 213 is exposed). When located at the opening position, the MP tray 40 is capable of supporting a plurality of sheets thereon. The MP tray side supplying mechanism 33 is configured to pick up a plurality of sheets supported by the MP tray 40 one by one in a separated manner and feeds the picked up sheet toward the first conveying roller 35. The MP tray side supplying mechanism 33 has an MP tray side pickup roller 331 and an MP tray side separation roller 332.

The MP tray side pickup roller 331 is for picking up one of the sheets which are supported by the MP tray 40. The MP tray side separation roller 332 is arranged on the downstream side, in the sheet conveying direction, with respect to the MP tray side pickup roller 331. The sheet(s) picked up by the MP tray side pickup roller 331 is fed toward the MP tray side separation roller 332. Then, one sheet is separated from the others (if any) by the MP tray side separation roller 332 and conveyed toward the first conveying roller 35.

The first conveying guide 34 is for guiding the sheet supplied from the MP tray 40 along a conveying passage P2 extending from the front wall 21 of the casing 2 toward the rear wall 22. The first conveying guide 34 is formed with, for example, ribs, and arranged, between the support member 9 and the sheet tray 10, to face a bottom wall 95 of the support member 9. The second conveying guide 91 is a guide having, for example, ribs formed on the bottom wall 95 of the support member 9. The sheet supplied from the MP tray 40 is guided along the conveying passage P2 by the first conveying guide 34 and the second conveying guide 9 which face each other.

The first conveying roller 35 is provided to the bottom wall 95 of the support member 9. The first conveying roller 35 is configured to convey the sheet in association with a driving roller 36 which is arranged to face the first conveying roller 35, the sheet being nipped between the conveying roller 35 and the driving roller 36. The second conveying roller 37 is provided to the bottom wall 95 of the support member 9 on the rear side with respect to the first conveying roller 35. The second conveying roller 37 conveys the sheet in association with a driving roller 38 which faces the second conveying roller 37, the sheet being nipped between the second conveying roller 37 and the driving roller 38.

According to the present embodiment, the image forming section 5 employs an electrophotographic imaging process. Concretely, the image forming section 5 includes a process cartridge 50 configured to transfer an image onto the surface of the sheet which is fed from the supplying section 3, and a transfer roller 55 arranged to face a photosensitive drum 54 of the process cartridge 50. The image forming section 5 further includes an exposure section 60 configured to emit light on the surface of the photosensitive drum 54, and a fixing section 70 configured to fix the image transferred, by the process cartridge 50, onto the sheet.

It is noted that the process cartridge 50 is attachably and detachably supported by the support member 9. The process cartridge 50 includes a developer storage chamber 51, a supplying roller 52, a developing roller 53, the photosensitive drum 54, a charging roller 57 and a cleaning roller 58.

The developer storage chamber 51 stores toner as the developer. The toner stored in the developer storage chamber 51 is agitated by an agitating member (not shown) and is sent to the supplying roller 52. The supplying roller 52 supplies the toner, which has been sent from the developer storage chamber 51, to the developing roller 53.

The developing roller 53 is arranged to closely contact with the supplying roller 52. The developing roller 53 carries the toner, which is supplied from the supplying roller 52 and positively charged by a not-shown sliding member. Further, to the developing roller 53, positive developing bias is applied by a not-shown bias applying device.

The photosensitive drum 54 is arranged, inside the casing 2, at a position closer to the rear wall 22 than the front wall 21. Further, the photosensitive drum 54 is arranged adjacent to the developing roller 53. A circumferential surface of the photosensitive drum 54 is uniformly charged by the charging roller 57. Then, the circumferential surface of the photosensitive drum 54 is exposed to light emitted by the exposure section 60. The charging roller 57 is cleaned by the cleaning roller 58. Potential of portions of the photosensitive drum 54 exposed to light is made lower than that of the other portions and an electrostatic latent image is formed, based on image data, on the circumferential surface of the photosensitive drum 54. Thereafter, as the positively charged toner is supplied from the developing roller 53, the electrostatic latent image is developed to be a developer image.

The transfer roller 55 is provided inside the casing 2. To the transfer roller 55, a negative transfer bias is applied by a not-shown bias applying device. When the transfer bias is applied on the surface of the transfer roller 55, by nipping and conveying the sheet between the photosensitive drum 54 carrying the developer image and the transfer roller 55 at a transfer position (i.e., the nip between the photosensitive drum 54 and the transfer roller 55), the developer image formed on the circumferential surface of the photosensitive drum 54 is transferred onto the surface of the sheet.

It is noted that the exposure section 60 has a laser diode, a polygonal mirror, lenses and a reflector. The exposure section 60 emits a laser beam, which is modulated based on the image data input to the image forming apparatus 1, is scanned with use of the polygonal mirror. As mentioned above, the surface of the photosensitive drum 54 is exposed to the scanning laser beam which is modulated based on the image data, thereby the electrostatic latent image being formed on the photosensitive drum 54.

The fixing section 70 has a heat roller 71 and a press roller 72. The heat roller 71 is driven, by a driving force transmitted from a generally-known motor, to rotate, while the heat roller 71 generates heat as electric power is supplied from a generally-known power source. The press roller 72 is arranged to face the heat roller 71 so as to be press-contacted with each other. As the heat roller 71 rotates, the press roller 72 is driven, by the rotating force of the heat roller 71, to rotate. When a sheet on which the developer image has been transferred is conveyed to the fixing section 70, the fixing section 70 conveys the sheet with nipping the sheet between the heat roller 71 and the press roller 72. As the heat and the pressure are applied to the sheet, the developer image is permanently fixed on the sheet.

The discharging section 8 has a discharge roller pair 81 and a discharge tray 82. The discharge roller pair 81 includes a pair of rollers and configured to discharge the sheet conveyed from the fixing section 70 to outside of the casing 2. The discharge tray 82 is formed on the upper wall 25 of the casing 2. On the discharge tray 82, the sheets discharged, by the discharge roller 81, to the outside of the casing 2 are stacked.

The image forming apparatus 1 according to the present embodiment employs a configuration which enables the user to visually recognize the portion subject to the jam processing. Hereinafter, referring to FIGS. 2-6, the configuration which enables the visual recognition of the portion subject to the jam processing will be described in detail.

Figure 2:
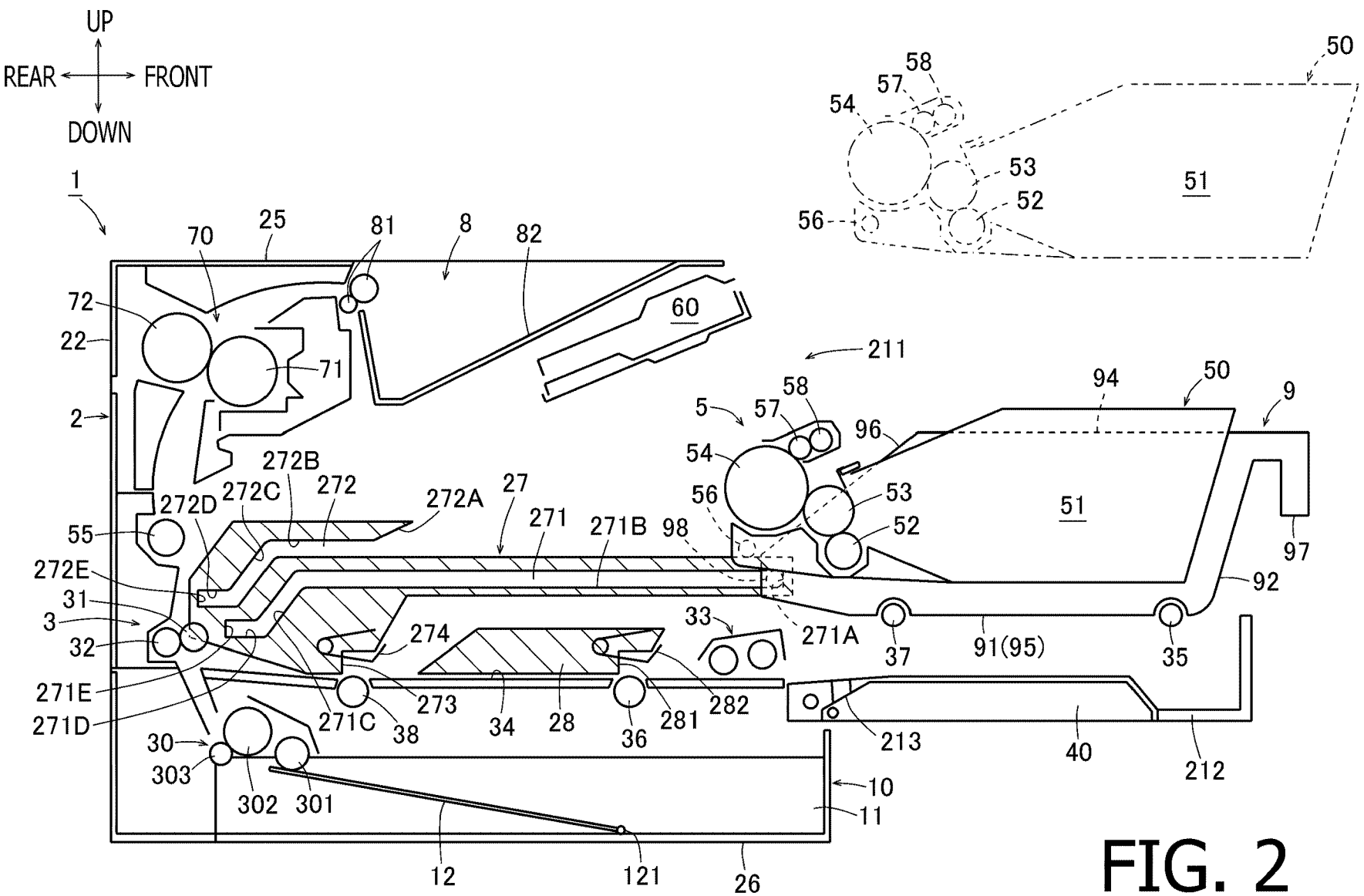
FIG. 2 is a side view schematically illustrating the image forming apparatus according to the first embodiment when a supporting member is located at a drawn position.
Figure 3:
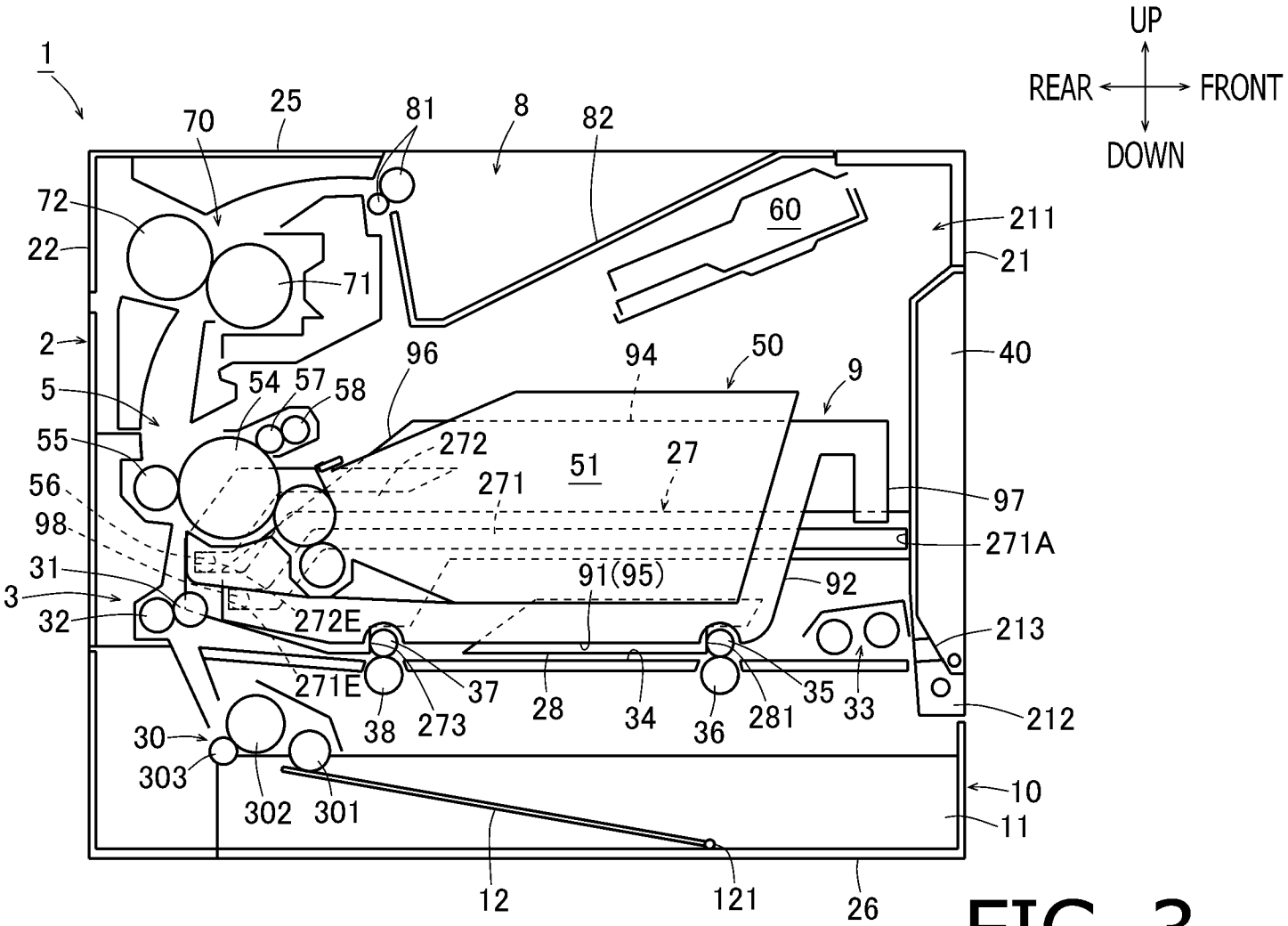
FIG. 3 is a side view schematically illustrating the image forming apparatus according to the first embodiment when the supporting member is located at an accommodated position.
Figure 4:
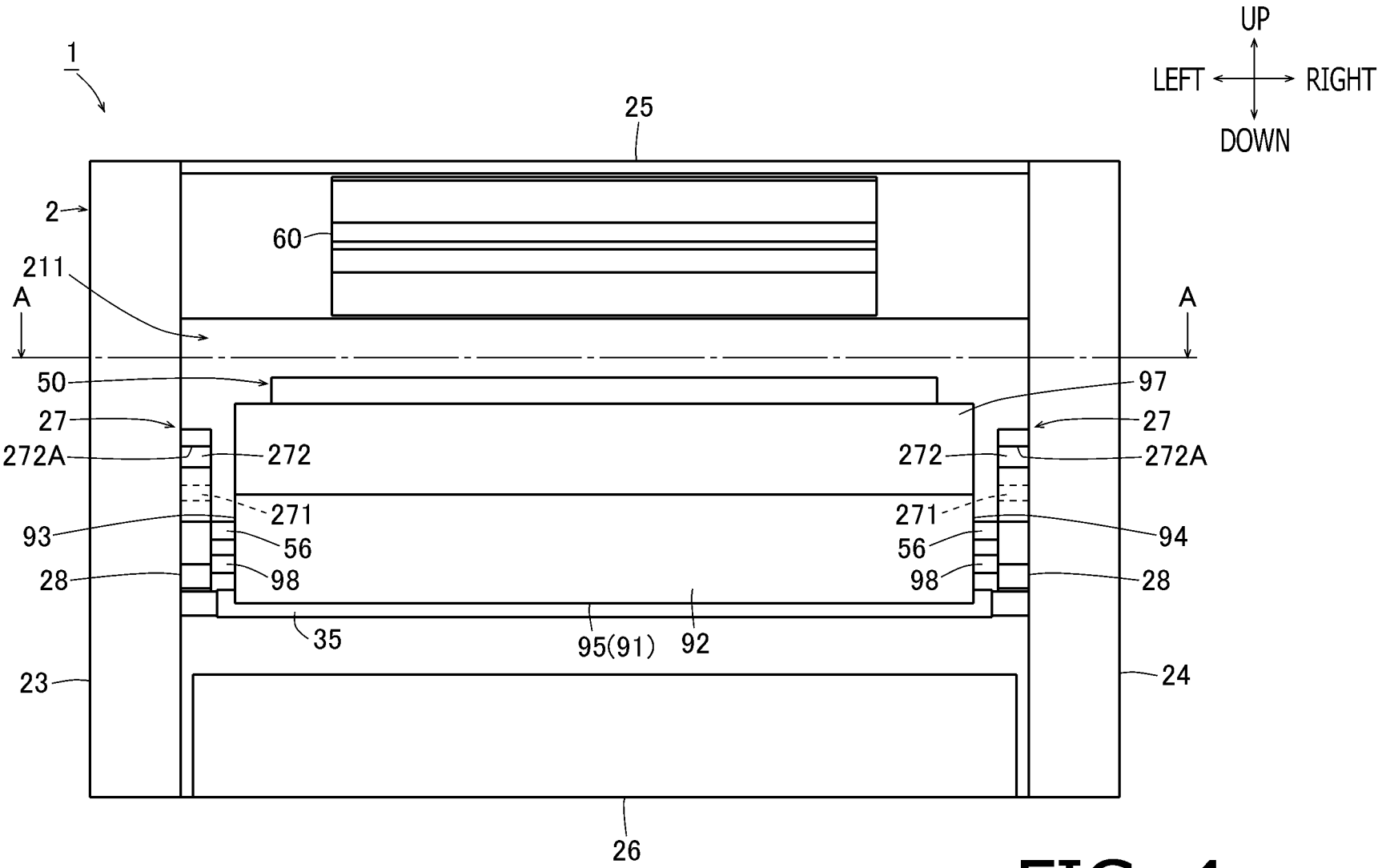
FIG. 4 is a front view of the image forming apparatus according to the first embodiment with a cover being removed.
Figure 5:
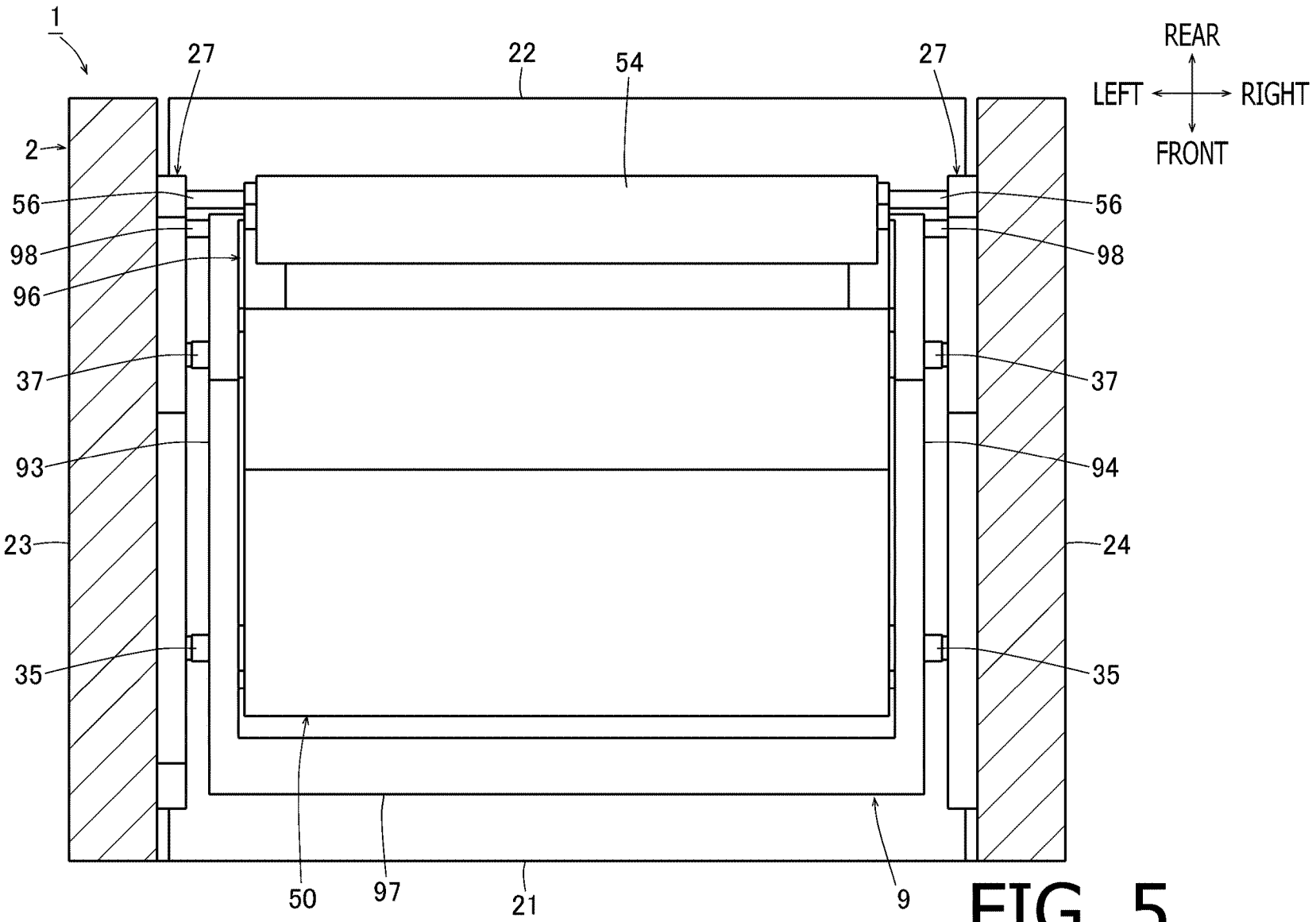
FIG. 5 is a cross-sectional view of the image forming apparatus which is take along line A-A of FIG. 4.
Figure 6A:
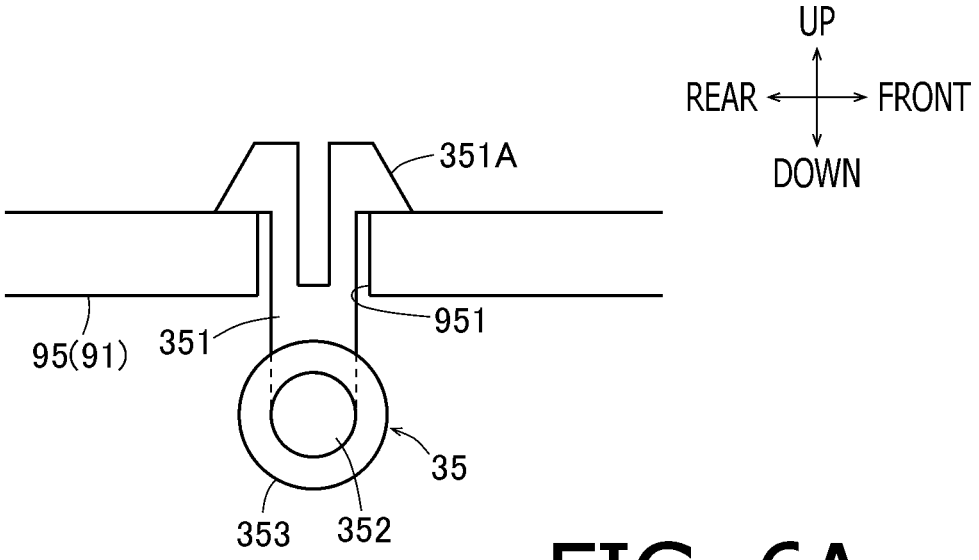
FIG. 6A illustrates a structure of a first conveying roller when the support member is located at the drawn position.
Figure 6B:
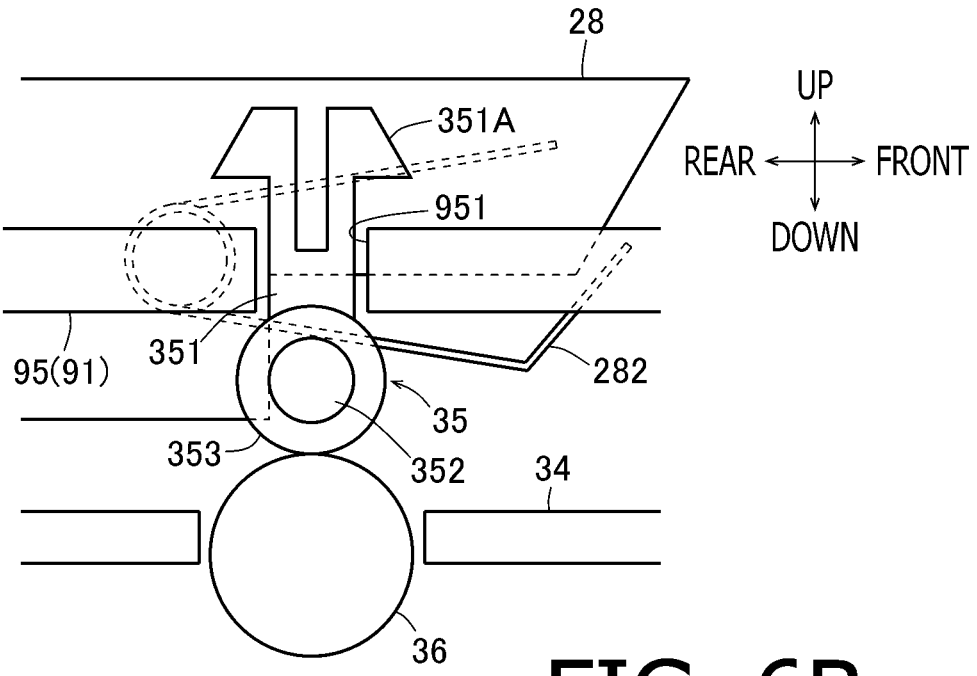
FIG. 6B illustrates the structure of a first conveying roller when the support member is located at the accommodated position.

FIG. 2 schematically shows a side view of the image forming apparatus 1 when the support member 9 is located at the drawn position, while FIG. 3 schematically shows a side view of the image forming apparatus 1 when the support member 9 is located at the accommodated position. FIG. 4 is a front view of the image forming apparatus 1 with the cover 212 being removed. FIG. 5 is a cross-sectional view of the image forming apparatus 1 taken along line A-A indicated in FIG. 4. FIGS. 6A and 6B illustrate a configuration of the first conveying roller 35 and FIG. 6A shows a case where the support member 9 is located at the drawn position, while FIG. 6B shows a case where the support member 9 is located at the accommodated position. It is noted that, in FIG. 2, a guiding member 27 and a positioning member 28 are hatched by oblique lines so as to be visually recognized easily.

<Support Member>

The support member 9 is configured to detachably and attachably support the process cartridge 50. Further, the second conveying guide 91 is formed on the support member 9. The support member 9 is a box-like member which has, as shown in FIGS. 2-5, a front wall 92, a left wall 93, a right wall 94, the bottom wall 95 on which the second conveying guide 91 is formed, an opened part 96 exposing the a rear wall and an upper wall, and a grip 97 protruded from the front wall 92. On the right wall 94 and the left wall 93, first protruded parts 98, which are cylindrical parts protruding outward in a horizontal direction (i.e., the right-left direction), are provided respectively and symmetrically with respect to the horizontal direction.

The support member 9 is configured to slide between the accommodated position (see FIG. 3) at which the support member 9 is accommodated inside the casing 2 and the drawn position (see FIG. 2) at which the support member 9 is drawn out of the casing 2 through the opening 211. When the support member 9 is moved to the drawn position, the process cartridge 50 can be exchanged and the jam processing can be performed.

<Process Cartridge>

The process cartridge 50 is accommodated in a part surrounded by the front wall 92, the left wall 93, the right wall 94 and the bottom wall 95 of the support member 9. According to the above configuration, the photosensitive drum 54 is exposed toward the rear wall 22 through the opened part 96. To portions of the right and left side faces of the process cartridge 50 which is protruded rearward through the opened part 96 of the support member 9, second protruded parts 56 which are cylindrical parts protruding outward in the horizontal direction are respectively provided symmetrically with respect to the right-left direction. The second protruded parts 56 are arranged on an upper side with respect to the first protruded parts 98, respectively.

<Guiding Members>

On inner surfaces of the left wall 23 and the right wall 24 of the casing 2, the guiding members 27 configured to guide the support member 9 and the process cartridge 50 are arranged symmetrically with respect to the right-left direction. Each of the guiding members 27 is formed with, as shown in FIGS. 2 and 3, a first groove 271 for guiding the first protruded part 98 and a second groove 272 for guiding the second protruded part 56 and a second positioning part 273 for positioning the second conveying roller 37.

As shown in FIG. 2, the size of the first groove 271 is defined such that the first protruded part 98 is movably supported by the first groove 271. The first groove 271 includes a front end part 271A which is a closed portion located in the vicinity of the front wall 21 of the casing 2. The first groove 271 further includes a horizontal part 271B extending rearward and horizontally, from the front end part 271A, an inclined part 271C inclining rearward and downward from the horizontal part 271B, a horizontal part 271D extending rearward and horizontally from the inclined part 271C, and a rear end part 271E which is a closed part following the horizontal part 217D and located in the vicinity of the rear wall 22 of the casing 2. The front end part 271A serves as a stopper which contacts the first protruded part 98 of the support member 9 to prevent the support member 9 from coming off from the drawing position. Further, when the rear end part 271E contacts the first protruded part 98 of the support member 9, the support member 9 is positioned.

The size of the second groove 272 is defined such that the second protruded part 56 is movably supported by the second groove 272. The second groove 272 is formed on an upper side with respect to the first groove 271 and extends along the first groove 271. That is, the second groove 272 includes a front end part 272A which is located in the vicinity of the rear wall 22 of the casing and formed to be opened frontward, a horizontal part 272B horizontally extending rearward from the front end part 272A, an inclined part 272C inclined rearward and downward from the horizontal part 272B, a horizontal part 272D horizontally extending rearward from the inclined part 272C and a rear end part 272E connected to the horizontal part 272D and located in the vicinity of the rear wall 22 of the casing and formed to be closed. As shown in FIG. 3, as the second protruded part 56 contacts the rear end part 272E, the process cartridge 50 is positioned.

As shown in FIG. 2, the second positioning part 273 is formed in the vicinity of the driving roller 38. The second positioning part 273 has a vertical surface, which is perpendicular to the front-rear direction. When the support member 9 is located at the accommodated position, the second conveying roller 37 contacts the vertical surface of the second positioning part 273 as shown in FIG. 3. Further, the second positioning part 273 is provided with a torsion coil spring 274 which is arranged such that one end of the torsion coil spring 274 protrudes frontward with respect to the second positioning part 273.

<Positioning Member>

As shown in FIG. 4, on inner surfaces of the left wall 23 and right wall 24 of the casing 2, positioning members 28 are arranged symmetrically with respect to the right-left direction. As shown in FIG. 2, each positioning member 28 has a first positioning part 281 which is used for positioning of the first conveying roller 35. The first positioning part 281 is located on the front side with respect to the second positioning part 273 and in the vicinity of the driving roller 36. The height position of the first positioning part 281 is the same as the height position of the second positioning part 273. The first positioning part 281 has a vertical surface which is perpendicular to the front-rear direction. When the support member 9 is located at the accommodated position, the first conveying roller 35 contacts the vertical surface of the first positioning part 281 as shown in FIG. 2. Further, the first positioning part 281 is provided with a torsion coil spring 282 which is arranged such that one end of the torsion coil spring 281 protrudes frontward with respect to the first positioning part 281.

<First Conveying Roller and Second Conveying Roller>

As shown in FIG. 6A, the first conveying roller 35 has an engaging part 351 which engages with a hole 951 formed on the bottom wall 95 of the support member 9, a rotatable shaft 352 which extends in the right-left direction and is rotatably supported by the engaging part 351 and a roller part 353 provided on a circumferential surface of the rotatable shaft 352. On an upper end of the engaging part 351, a claw part 351A is formed to engage with the hole 951 of the support member 9.

The first conveying roller 35 is movable in the up-down direction. When the support member 9 is located at the drawn position, the first conveying roller 35 is located at its lowermost position by its own weight as shown in FIG. 6A. When the support member 9 is located at the accommodated position, as shown in FIG. 6B, the first conveying roller 35 contacts the driving roller 36 and is lifted up thereby, while urged downward by the torsion coil spring 282. Thus, the first conveying roller 35 and the driving roller 36 form a nip therebetween. It is noted that the structure of the second conveying roller 37 is the same as that of the first conveying roller 35, and a detailed description thereof will be omitted for brevity.

<Effects>

According to the above-described configuration, as shown in FIG. 2, by moving the support member 9 to the drawn position, the second conveying guide 91 moves frontward and the upper part of the conveying passage P2 is exposed to outside. Accordingly, the user can visually recognize a portion subject to the jam processing from an obliquely upper side thereof. That is, according to the above-described configuration, it is easy to visually recognize the portion subject to the jam processing in comparison with a conventional configuration of completely removing the sheet tray.

Further, only by one operation of sliding the support member 9 from the accommodated position to the drawn position, the conveying passage P2 defined by the first conveying guide 34 and the second conveying guide 91 is exposed to outside. Therefore, in comparison with a conventional configuration in which two operations (i.e., a first operation of drawing the sheet tray and a second operation of moving down the conveyance guide) are required, the jam processing can be done easily.

According to the above-described configuration, the opened part 96 is formed to the support member 9. By forming the rear wall 22 side of the support member 9 as the opened part 96 which does not have walls, the support member 9 does not obstacles the jam processing after the support member 9 is slid do the drain position and the process cartridge 50 is removed (as indicated by two-dotted lines in FIG. 2). Thus, in comparison with a case where the rear wall 22 side of the support member 9 is formed to have walls, the jam processing can be performed much easier.

According to the above-described configuration, by positioning the first conveying roller 35 with use of the positioning member 28 provided to the casing 2, the first conveying roller 35 can be positioned with high accuracy. The same effects can be achieved by the second positioning part 273. It is noted that one of the first positioning part 281 and the second positioning part 273 may be omitted.

According to the first conveying roller 35 and the second conveying roller 37, conveyance resistance of the sheet in the conveying passage P2 can be reduced, thereby the sheet being conveyed smoothly. Further, by configuring the first conveying roller 25 and the second conveying roller 37 as driven rollers, it become unnecessary to provide a complex mechanism to transmit a driving force to the rollers which are provided to the movable support member 9.

Second Embodiment

Figure 7:
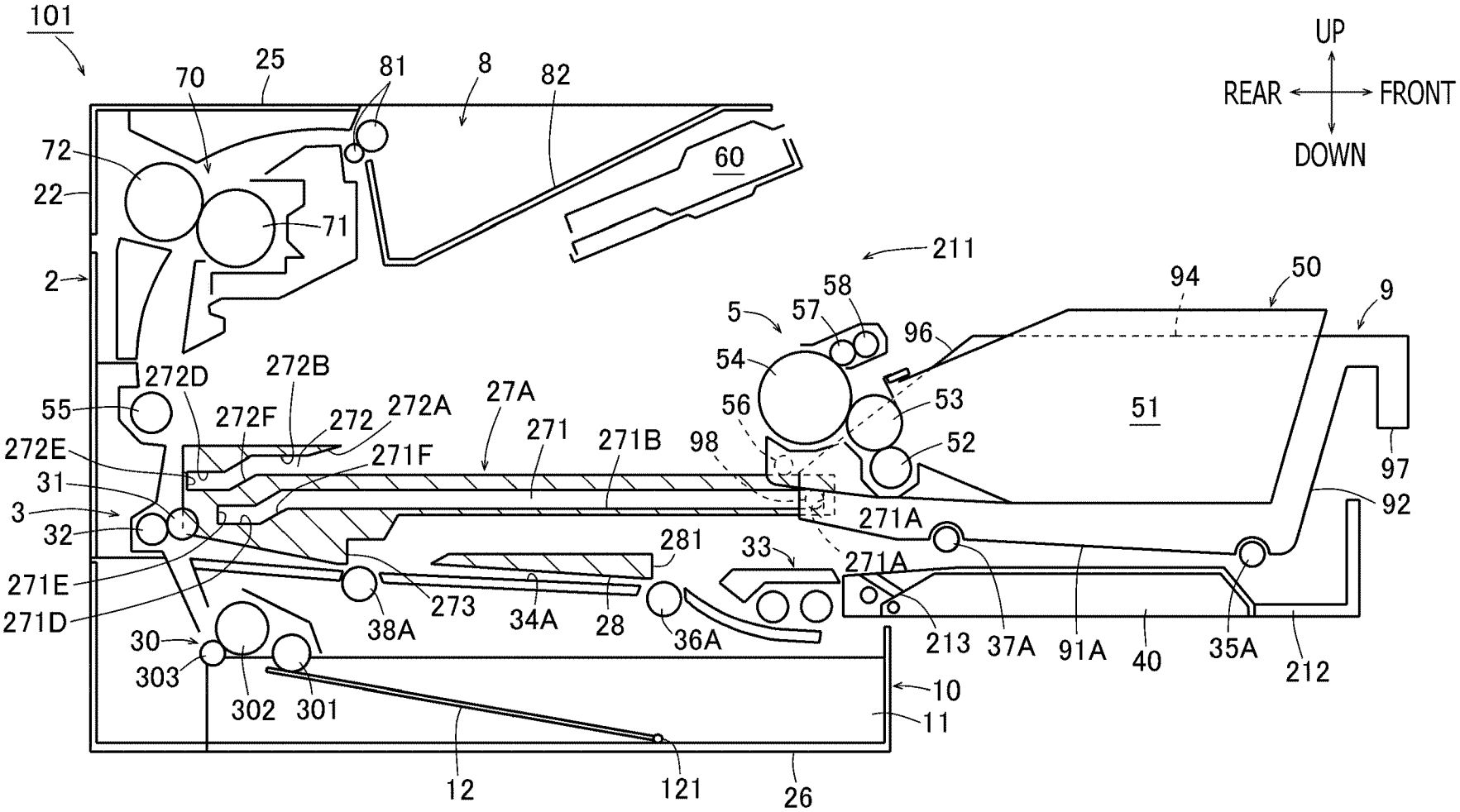
FIG. 7 is a side view schematically illustrating an image forming apparatus according to a second embodiment when a supporting member is located at a drawn position.
Figure 8:
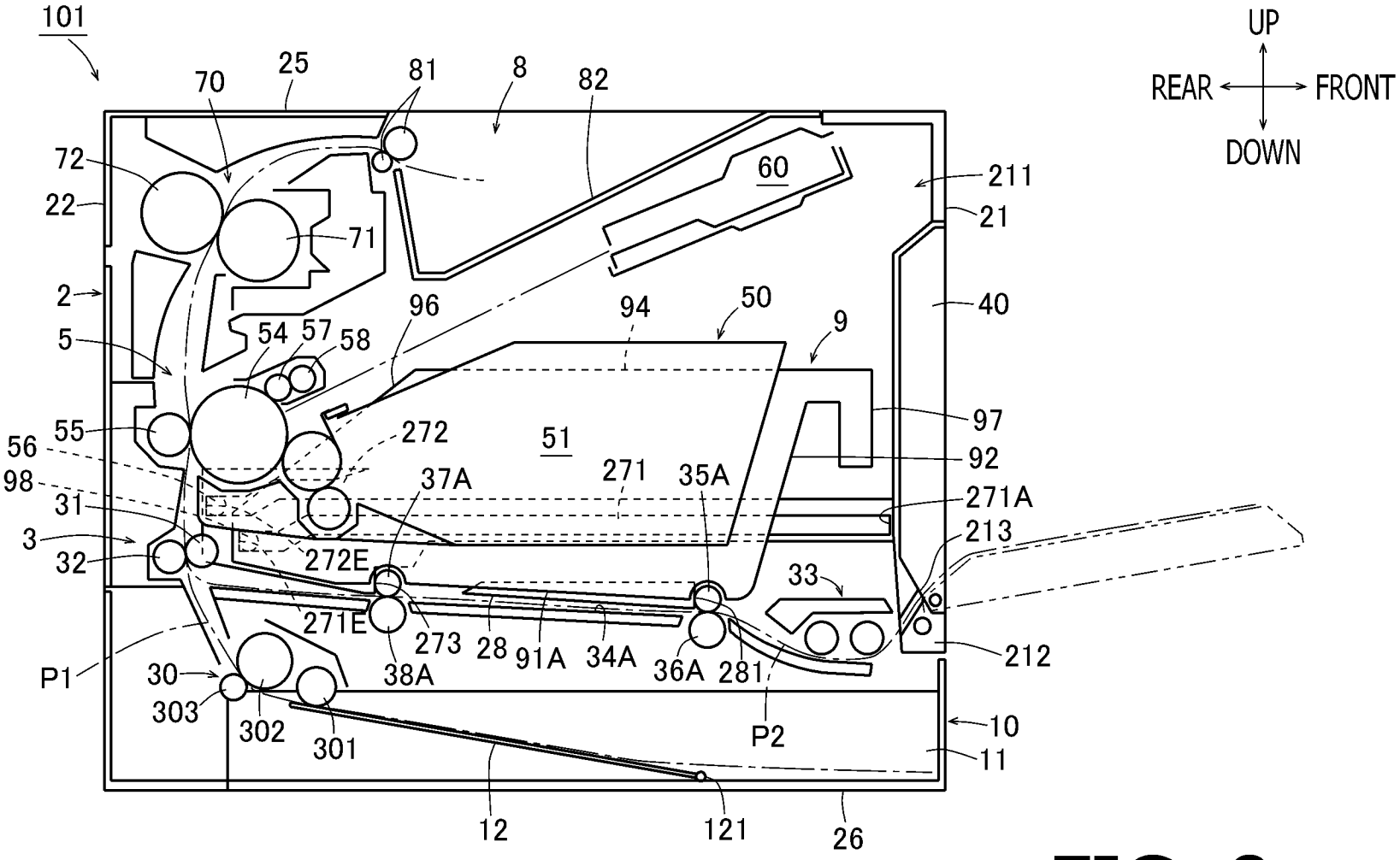
FIG. 8 is a side view schematically illustrating the image forming apparatus according to the second embodiment when the supporting member is located at an accommodated position.

FIG. 7 shows an image forming apparatus 101 according to a second embodiment of the present disclosures. It is noted that FIG. 7 shows a state where the support member 9 is located at the drawn position, while FIG. 8 shows the image forming apparatus 101 when the support member 9 is located at the accommodated position. In FIG. 7, a guiding member 27A and a positioning member are hatched with oblique lines so as to be easily recognized. In the following description, configurations different from those in the first embodiment are mainly described. The components same as those in the first embodiment are assigned with the same reference numbers and detailed descriptions thereof will be omitted for brevity.

The image forming apparatus 101 has, as configurations different from those of the image forming apparatus 1 according to the first embodiment, a first conveying guide 34A, a first conveying roller 35A, a second conveying roller 37A, a second conveying guide 91A, a driving roller 36A arranged to face the first conveying roller 35A, a driving roller 38A arranged to face the second conveying roller 37A and a guiding member 27A.

In a state shown in FIG. 8, the first conveying guide 34A and the second conveying guide 91A are arranged to face each other, both being inclined such that rear sides thereof are higher than front sides thereof. Further, the second conveying roller 37A and the driving roller 38A are arranged at higher levels than the first conveying roller 35A and the driving roller 36A, respectively. In accordance with the first conveying roller 35A being arranged at a relatively lower position, the MP tray side supplying mechanism 33 is also arranged at a lower position.

According to the above configuration, when the support member 9 is slid horizontally for insertion or removal, the second conveying roller 37A and the driving roller 36A may hardly interfere with each other. Therefore, the guiding member 27A may be configured such that an inclined part 271F and an inclined part 272F can be made shorter than the inclined part 271C and the inclined part 272C of the first embodiment, respectively. According to the above configuration, moving amount in the up-down direction (i.e., a difference of heights of the support member 9 shown in FIG. 7 and in FIG. 8) when the support member 9 is slid is suppressed, thereby an operability being improved.

Third Embodiment

Figure 9:
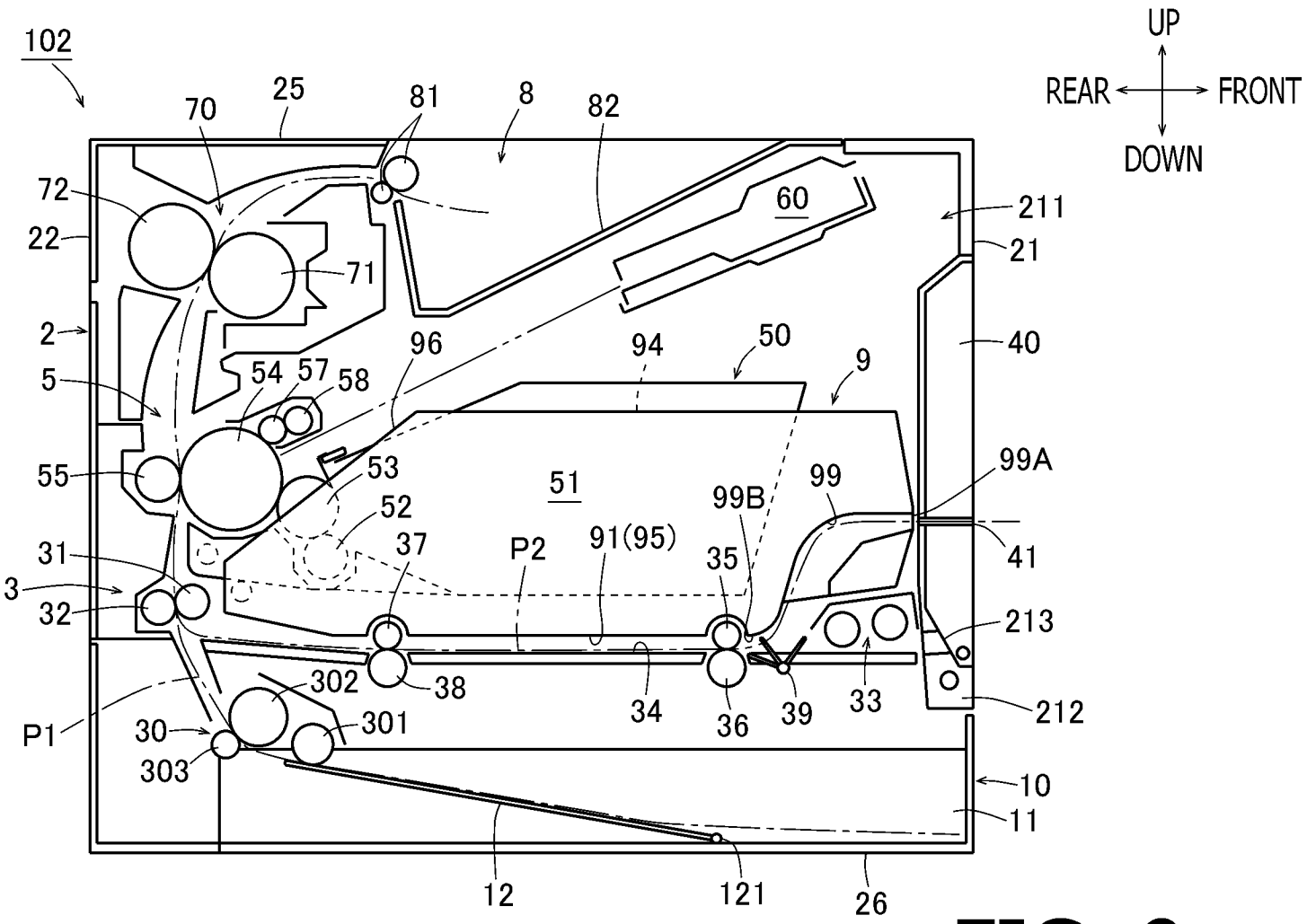
FIG. 9 is a side view schematically illustrating an image forming apparatus according to a third embodiment.

FIG. 9 shows an image forming apparatus 102 according to a third embodiment of the present disclosures. In the following description, configurations different from those of the third embodiment will be mainly described, while configurations similar to those of the first embodiment are assigned with the same reference numbers and detailed description thereof will be omitted for brevity. As the configurations different from the image forming apparatus 1 according to the first embodiment, the image forming apparatus 102 has a sheet insertion section 41, a curved guide 99 (which an example of a third conveying guide) and a sheet sensor 39.

The sheet insertion part 41 is an opening through which the sheets are to be inserted one by one. The sheet insertion part 41 is formed on the MP tray 40 at a position facing the support member 9 when the MP tray 40 is located at the closing position. The sheet insertion part 41 is formed to penetrate through the MP tray 40 in the front-rear direction, and has a size allowing the sheets to pass through.

The curved guide 99 is formed on a front part of the support member 9. The curved guide 99 has ribs and is for guiding the sheet inserted through the sheet insertion part 41 to the conveying passage P2. One end 99A of the curved guide 99 is arranged at a position facing the sheet insertion part 41 formed on the front wall 92 of the support member 9, while the other end 99B of the curved guide 99 is arranged on the bottom wall 95 of the support member 9 at a position on a front side with respect to the first conveying roller 35. A portion between the one end 99A and the other end 99B is formed as a curved surface (i.e., each rib has a curved surface) in order that the sheet is conveyed smoothly.

The sheet sensor 39 is a mechanical sensor for detecting a sheet being conveyed, and is arranged on the conveying passage P2 at a position on the front side with respect to the first conveying roller 35. As the leading end of the sheet inserted through the sheet insertion part 41 pushes down the sheet sensor 39, the image forming apparatus 102 detects insertion of the sheet and drives the driving roller 36.

As described above, with the image forming apparatus 102 according to the third embodiment, the sheet can be supplied through the sheet insertion part 41 easily without deteriorating easiness of exchangeability of the process cartridge 50. Further, operability of the image forming apparatus 102 is improved since the number of the sheet supplying passages is increased.

Fourth Embodiment

Figure 10:
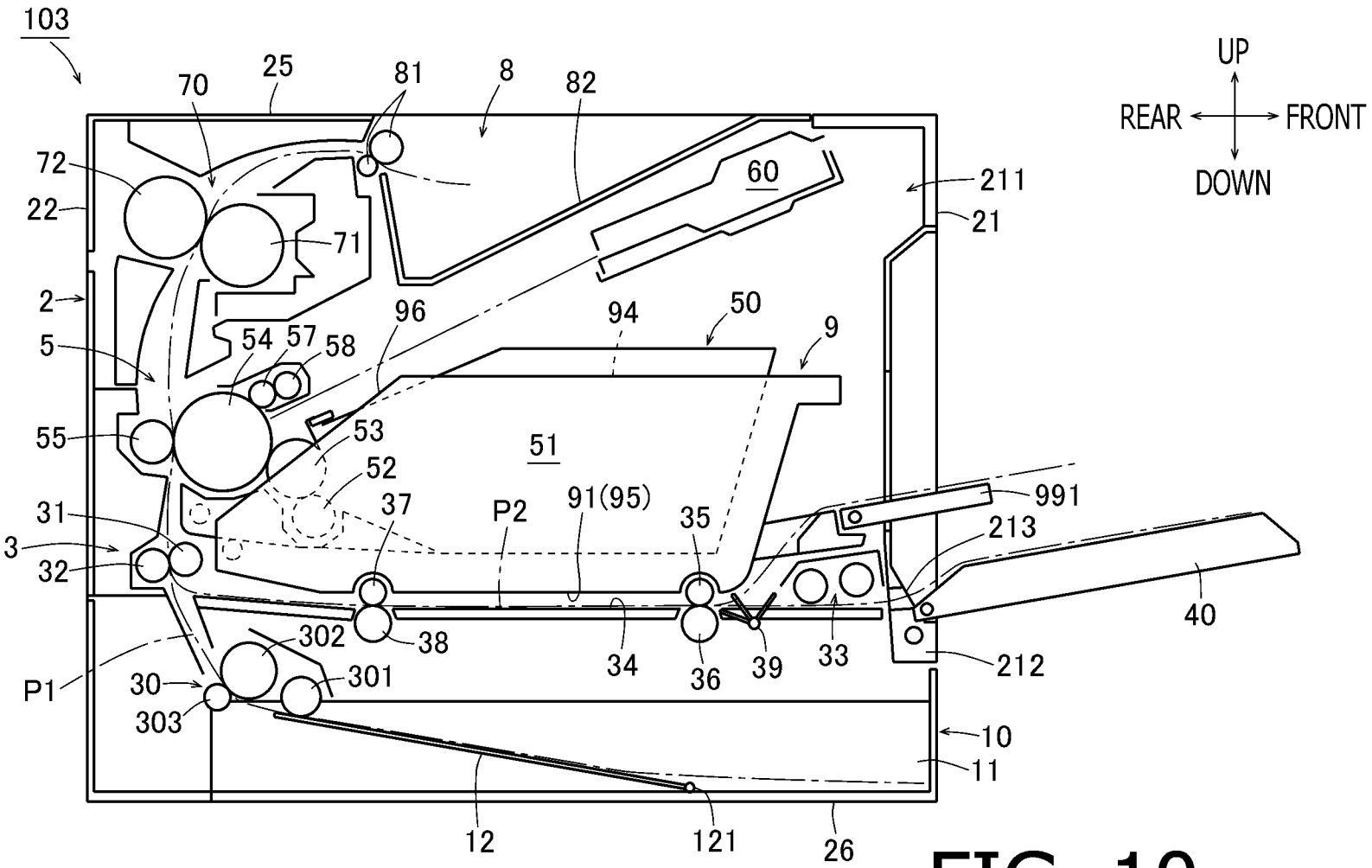
FIG. 10 is a side view schematically illustrating an image forming apparatus according to a fourth embodiment when an MP tray and a guide tray are opened state.
Figure 11:
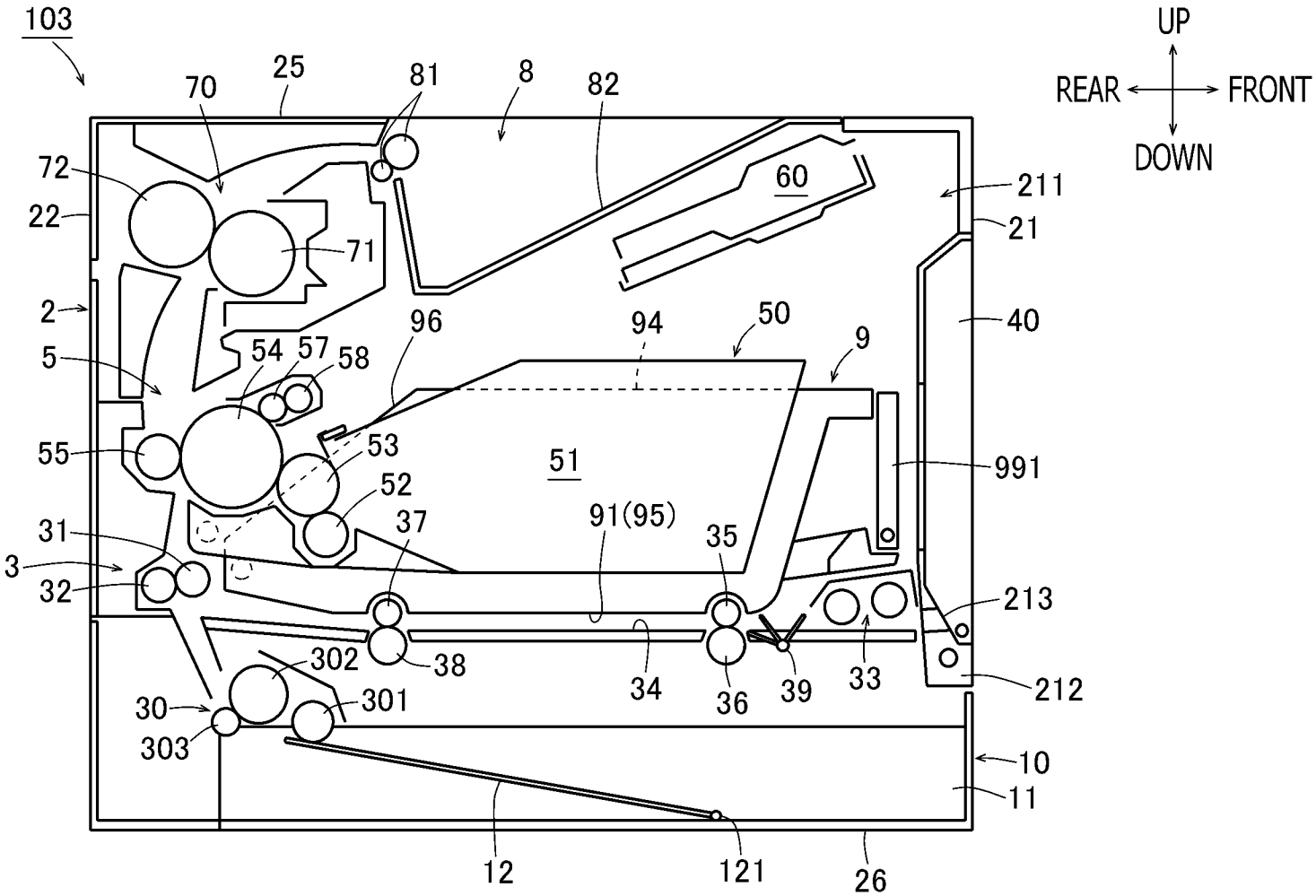
FIG. 11 is a side view schematically illustrating the image forming apparatus according to the fourth embodiment when the MP tray and the guide tray are closed state.

FIG. 10 shows an image forming apparatus 103 according to a fourth embodiment of the present disclosures. The image forming apparatus 103 employs another configuration to introduce the sheet to the conveying passage P2 instead of the curved guide 99 employed in the image forming apparatus 102 according to the third embodiment. FIG. 10 shows a state where the MP tray 40 and a guide tray 991 are opened, while FIG. 11 shows a state where the MP tray 50 and the guide tray 991 are closed. As the configurations different from the image forming apparatus 1 according to the first embodiment, the image forming apparatus 103 has the guide tray 991, which is an example of a third conveying guide, and the sheet sensor 39, which is the same as that of the third embodiment.

The guide tray 991 is formed on a front side of the support member 9 and is configured to guide the sheet supplied through an opening 213 to the conveying passage P2. The guide tray 991 is rotatably supported by the support member 9 such that the guide tray 991 is rotatable between a closing position at which the guide tray 991 stands upright (i.e., a position shown in FIG. 11) and an opening position (i.e., a position shown in FIG. 10) at which the guide tray 991 inclines toward the opening 213, or falls frontward through the opening 213. The guide tray 991 is configured to guide the sheet toward the first conveying roller 35 when located at the opening position.

With the image forming apparatus 103 according to the fourth embodiment, a sheet can be supplied through the guide tray 991. Further, since the number of the sheet supplying passages is increased, the operability of the image forming apparatus is improved.

Fifth Embodiment

Figure 12:
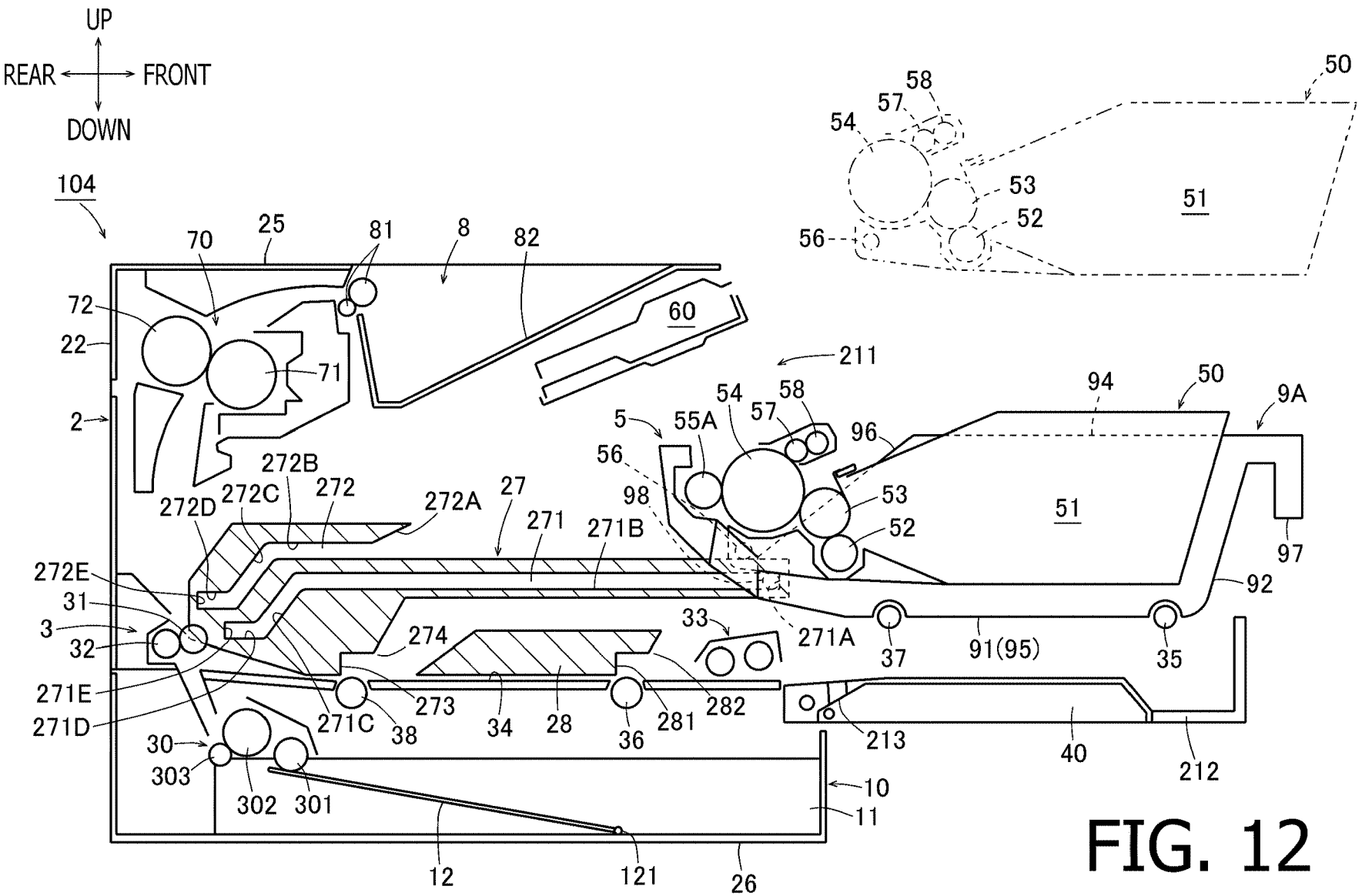
FIG. 12 is a side view schematically illustrating an image forming apparatus according to a fifth embodiment when a supporting member is located at a drawn position.
Figure 13:
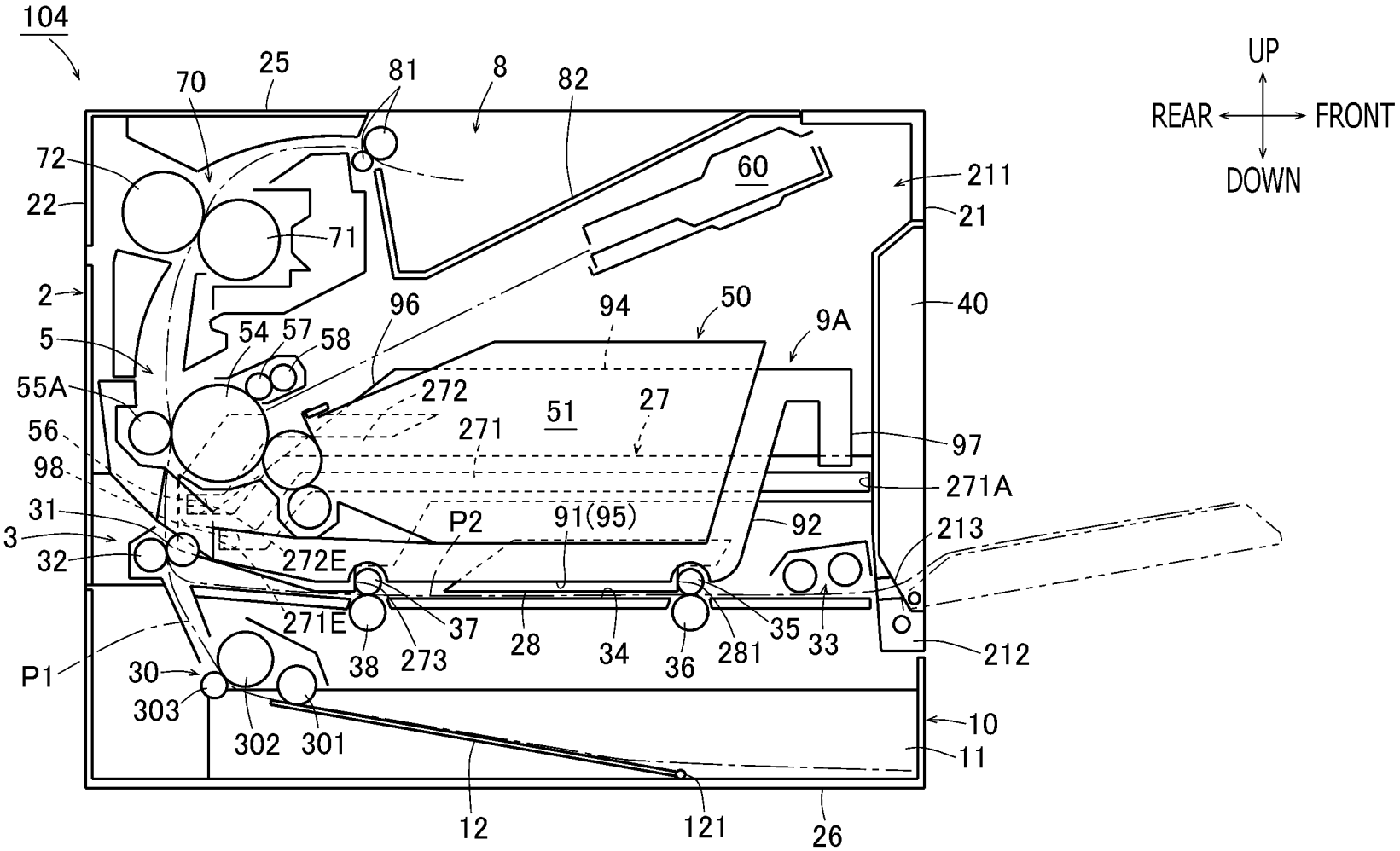
FIG. 13 is a side view schematically illustrating the image forming apparatus according to the fifth embodiment when the supporting member is located at an accommodated position.

FIG. 12 shows an image forming apparatus 104 according to a fifth embodiment. FIG. 12 shows a state where a support member 9A is located at the drawn position, while FIG. 13 shows a state where the support member 9A is located at the accommodated position. In FIG. 12, the guiding member 27 and the positioning member are hatched with oblique lines so as to be visually recognizable easily. In the following description, configurations different from those of the first embodiment are mainly described. Configurations the same as those of the first embodiment are assigned with the reference numbers same as those used in the first embodiment and the detailed description thereof will be omitted for brevity. It is noted that the image forming apparatus 104 has, as configurations different from those in the first embodiment, the support member 9A.

The support member 9A has a transfer roller 55A which is arranged to face the photosensitive drum 54. It is noted that, according to the first embodiment, the transfer roller 55 of the first embodiment provided to the casing 2. In contrast, according to the fifth embodiment, the transfer roller 55A is provided to the support member 9A and is movable together with the support member 9A.

According to the fifth embodiment, when the support member 9A is moved to the drawn position, the transfer roller 55A is also drawn out of the casing 2. Accordingly, the sheet jammed between the photosensitive drum 54 and the transfer roller 55A can be drawn, together with the support member 9A, out of the casing 2. Thus, the jam processing can be performed easily.

Sixth Embodiment

Figure 14:
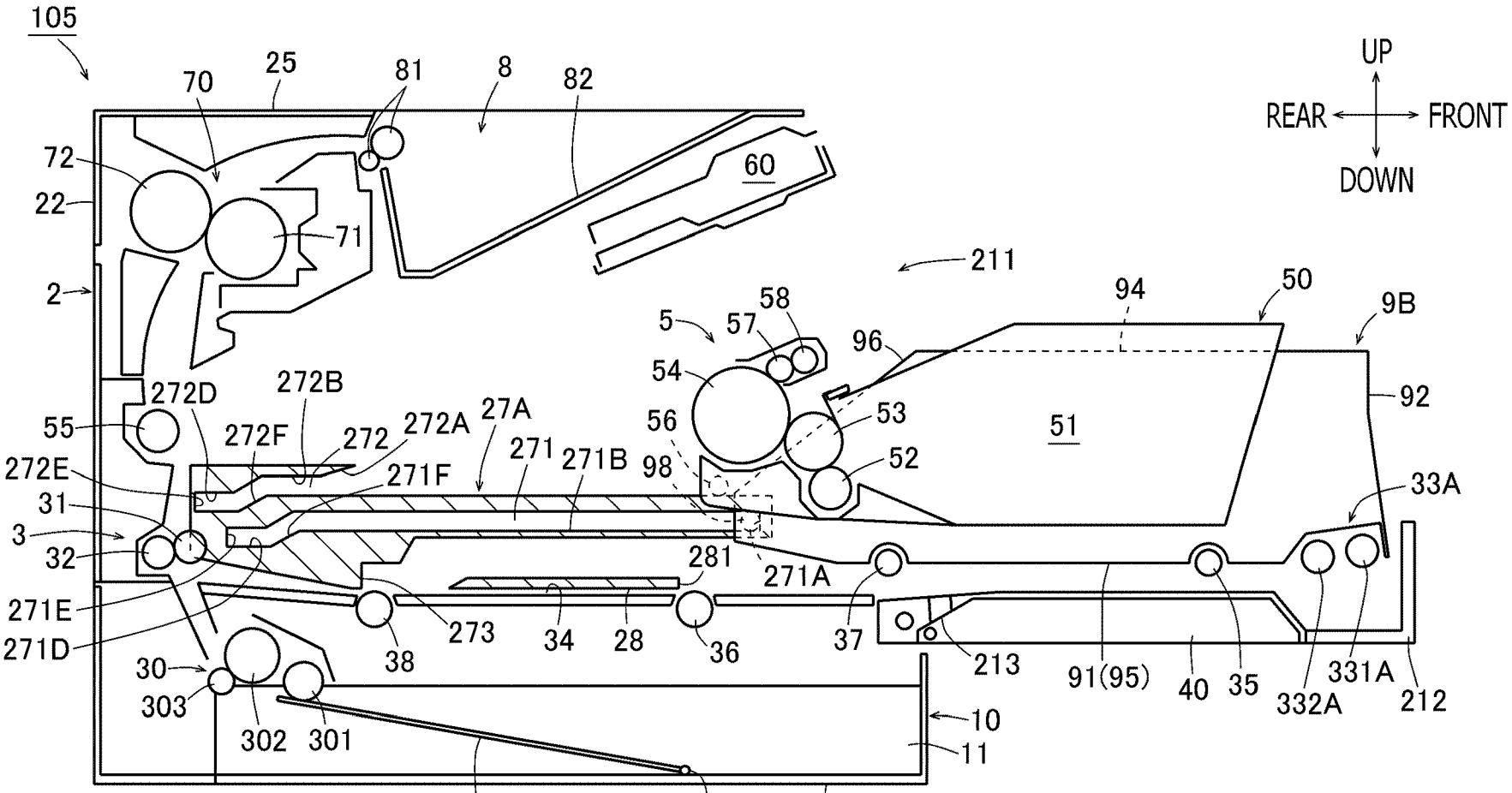
FIG. 14 is a side view schematically illustrating an image forming apparatus according to a sixth embodiment when a supporting member is located at a drawn position.
Figure 15:
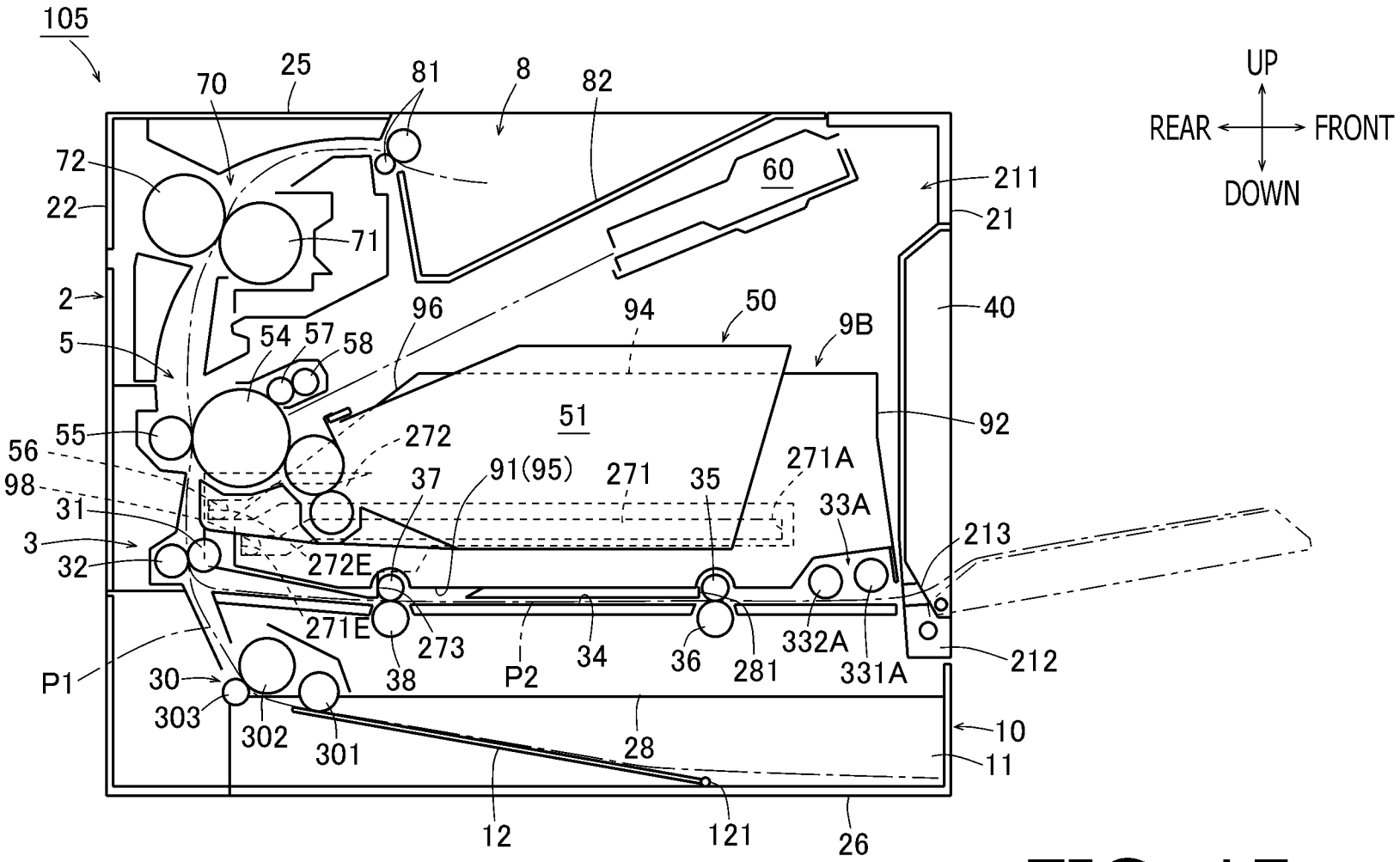
FIG. 15 is a side view schematically illustrating the image forming apparatus according to the sixth embodiment when the supporting member is located at an accommodated position.

FIG. 14 shows an image forming apparatus 105 according to a sixth embodiment of the present disclosures. FIG. 14 shows a state where a support member 9B is located at the drawn position, while FIG. 15 shows a state where the support member 9B is located at the accommodated position. In FIG. 14, the guiding member 27 and the positioning member are hatched with oblique lines so as to be easily recognized. In the following description, configurations different from those of the first embodiment will be mainly described. Configurations the same as those of the first embodiment will be assigned with the same reference numbers and the detailed description thereof will be omitted for brevity. The image forming apparatus 105 has a support member 9B which is a configuration different from that of the image forming apparatus 1 according to the first embodiment.

The support member 9B has an MP tray side supplying mechanism 33A at a lower front portion thereof. The MP tray side supplying mechanism 33A has an MP tray side pickup roller 331A and an MP tray side separation roller 332A. It is noted that, in the first embodiment, the MP tray side supplying mechanism 33 is provided to the casing 2. In contrast, according to the sixth embodiment, the MP tray side supplying mechanism 33A is provided to the support member 9B. According to this configuration, the MP tray side supplying mechanism 33A is movable together with the support member 9B.

Since the MP tray side supplying mechanism 33A is drawn as the support member 9B is moved to the drawn position. Therefore, when the support member 9B is inserted into or drawn from the casing 2, it does not interfere with the MP tray side supplying mechanism 33A and the operability is improved.

Effects of the Embodiments

The image forming apparatus according to the first embodiment is the image forming apparatus 1 employing the electrophotographic imaging method and has the casing 2. The casing 2 has the front wall 21 on which the opening 211 is formed and the rear wall 22 arranged to face the front wall 21. The image forming apparatus 1 further includes the photosensitive drum 54, which is arranged, inside the casing 2, at the position closer to the rear wall 22 than the front wall 21. The image forming apparatus 1 further includes the support member 9 which supports the photosensitive drum 54 and is slidably movable between the accommodated position at which the photosensitive drum 54 is located inside the casing 2 and the drawn position at which the photosensitive drum 54 is drown out of the casing 2 through the opening 211 formed on the front wall 21. The image forming apparatus 1 further includes the sheet tray 10 arranged, inside the casing 2, at the position lower than the support member 9. The sheet tray 10 supports the sheets. Still further, the image forming apparatus 1 has the separation roller 302 which is arranged, inside the casing 2, at the position closer to the rear wall 22 than the front wall 21 and is configured to feed the sheet supported by the sheet tray 10. The image forming apparatus 1 is further provided with the first conveying guide 34 which is arranged to face the support member 9 between the support member 9 and the sheet tray 10 and is configured to guide, inside the casing 2, the sheet inserted through the opening 213 from the front wall 21 to the rear wall 22. Furthermore, the image forming apparatus 1 is provided with the second conveying guide 91 which is arranged to support member 9 at the position facing the first conveying guide 34 and is configured to guide the sheet inserted through the opening 213.

According to the above configuration, by moving the support member 9 to the drawn position, the second conveying guide 91 moves out of the casing 2 and the upper portion of the conveying passage P2 is opened. Accordingly, the user can visually recognize the portion subject to the jam processing from an obliquely upper position thereof. In comparison with the conventional configuration in which the sheet tray is withdrawn and the user look into the casing through the opening from which the sheet tray 10 is withdrawn, the user can visually recognize the portion easier. Further, with only one operation of sliding the support member 9 from the accommodated position to the drawn position, the conveying passage P2 defined by the first conveying guide 34 and the second conveying guide 91 is opened, the jam processing can be performed much easier in comparison with a conventional case where two operations of withdrawing the sheet tray and then moving the conveying guide downward are necessary to perform the jam processing.

The image forming apparatus 1 according to the first embodiment is configured that the second conveying guide 91 of the support member 9 includes the first conveying roller 35 for conveying the sheet.

According to the above configuration, with use of the first conveying roller 35, the conveying resistance of the sheet can be reduced, thereby the sheet being conveyed smoothly.

The image forming apparatus 1 according to the first embodiment is configured such that the driving roller 36 which forms a nip in association with the first conveying roller 35 is provided to the casing 2. The first conveying roller 35 is a driven roller which is driven by the rotation of the driving roller 36.

According to the above configuration, a complex mechanism for inputting the driving force to the first conveying roller 35 provided to the support member 9 is not necessary.

In the image forming apparatus 1 according to the first embodiment, the casing 2 has the first positioning part 281 which is configured to position the first conveying roller 35 when the support member 9 is located at the accommodated position.

According to the above configuration, by positioning the first conveying roller 35 with use of the first positioning part 281 provided to the casing 2, the first conveying roller 35 can be positioned with high accuracy.

The image forming apparatus 101 according to the second embodiment is configured such that the support member 9 has the second conveying roller 37A. When the support member 9 is located at the accommodated position, the second conveying roller 37A conveys the sheet guided by the second conveying guide 91A on the rear wall 22 side with respect to the first conveying roller 35A and on an upper level with respect to the first conveying roller 35A.

According to the above configuration, since the second conveying roller 37A is arranged at the upper level than the first conveying roller 35A, an operability in sliding the support member 9 is excellent.

In the image forming apparatus 1 according to the first embodiment, on the rear wall 22 side portion of the support member 9, an opened part exposing the photosensitive drum 54 without covering the same is provided.

According to the above configuration, the opened part 96, which does not have any walls, is formed on the support member 9 at the position on the rear wall 22 side thereof. With this configuration, by sliding the support member 9 to the drawn position and then removing the process cartridge 50 from the support member 9, the jam processing can be performed easier in comparison with a case where there remains walls which may obstacle the jam processing.

With the image forming apparatus 102 according to the third embodiment or 103 according to the fourth embodiment, the support member 9 is provided with the curved guide 99 or the guide tray 991 configured to guide the sheet toward the portion between the first conveying guide 34 and the second conveying guide 91.

According to the above configuration, the sheets can be supplied through the curved guide 99 or the guide tray 991. Further, the number of the sheet supplying passages is increased, thereby operability being improved.

In the image forming apparatus 104 according to the fifth embodiment, the transfer roller 55A for transferring the toner image onto the sheet is arranged on the support member 9A at the position facing the photosensitive drum 54.

According to the above configuration, by moving the support member 9A to the drawn position, the transfer roller 55A is also drawn, it becomes possible to withdraw the sheet jammed at the position between the photosensitive drum 54 and the transfer roller 55A and the jam processing can be performed easily.

What is claimed is:

1. An image forming apparatus configured to form an image in accordance with an electrophotographic image forming method, comprising:

a casing comprising:

a front wall having an opening, a rear wall, and a first conveying guide configured to guide sheet inserted through the opening in a direction from the front wall toward the rear wall;

a process cartridge comprising a photosensitive drum;

a support member comprising a second conveying guide configured to guide sheet inserted through the opening, the support member configured to support the process cartridge, and the support member being slidably movable between an accommodated position at which the process cartridge supported on the support member is located inside the casing and a drawn position at which at least a part of the process cartridge supported on the support member is located out of the casing through the opening on the front wall;

a sheet tray configured to support sheet, the sheet tray being arranged inside the casing at a lower position with respect to the support member when the support member is at the accommodated position; and a pair of registration rollers arranged inside the casing at a position closer to the rear wall than the front wall, the pair of registration rollers being configured to convey a sheet, wherein, when the support member is at the accommodated position, the second conveying guide faces the first conveying guide.

2. The image forming apparatus according to claim 1, wherein the second conveying guide comprises a first conveying rolleronfigured to convey sheet.

3. The image forming apparatus according to claim 2, further comprising a driving roller inside the casing, wherein, when the support member is at the accommodated position, the driving roller forms a nip in association with the first conveying roller, and wherein, when the support member is at the accommodated position, the first conveying roller is driven by a rotation of the driving roller.

4. The image forming apparatus according to claim 2, wherein the casing further comprises a positioning member, and wherein, when the support member is at the accommodated position, the positioning member positions the first conveying roller.

5. The image forming apparatus according to claim 2, wherein the support member comprises a second conveying roller configured to convey the sheet guided by the second conveying guide, and wherein, when the support member is at the accommodated position, the second conveying roller is disposed at an upper position with respect to the first conveying roller and on the rear wall side position with respect to the first conveying roller.

6. The image forming apparatus according to claim 1, further comprising a transfer roller configured to transfer toner from the photosensitive drum to sheet, wherein, when the process cartridge is supported on the support member and the support member is at the accommodated position, the transfer roller is disposed between the rear wall and the photosensitive drum.

7. The image forming apparatus according to claim 1, wherein the support member further comprises a third conveying guide; wherein, when the support member is at the accommodated position, the third conveying guide is on an upstream side, in a sheet conveying direction, with respect to the first conveying guide, and wherein, when the support member is at the accommodated position, the third conveying guide guides sheet toward a portion between the first conveying guide and the second conveying guide.

8. The image forming apparatus according to claim 7, wherein the third conveying guide is formed with a curved surface on a front part of the support member.

9. The image forming apparatus according to claim 7, wherein the support member comprises a guide tray rotatably provided at a front part of the support member.

10. The image forming apparatus according to claim 1, further comprising a transfer roller arranged on the support member at a position facing the photosensitive drum configured to transfer toner from the photosensitive drum to sheet.

11. The image forming apparatus according to claim 1, wherein, when the support member is at the drawn position and the process cartridge is detached from the support member, the first conveying guide of the casing is accessible through the opening.

* * * * *